United States Patent [19]

Cuperman et al.

[11] Patent Number: 4,963,034

[45] Date of Patent: Oct. 16, 1990

[54] LOW-DELAY VECTOR BACKWARD PREDICTIVE CODING OF SPEECH

[75] Inventors: Vladimir M. Cuperman, North Vancouver; Robert Pettigrew, Richmond; Lloyd Watts, Coquitlam, all of Canada

[73] Assignee: Simon Fraser University, Burnaby, Canada

[21] Appl. No.: 360,023

[22] Filed: Jun. 1, 1989

[51] Int. Cl.[5] ..... G10L 5/00

[52] U.S. Cl. ..... 381/36; 381/35; 381/30

[58] Field of Search ..... 381/36, 35, 30

[56] References Cited

PUBLICATIONS

Makhoul, J., "Linear Prediction: A Tutorial Review", Proceedings of the IEEE, vol. 63, No. 4, Apr. 1975, pp. 561–580.

Widrow, B., et al., "Stationary and Nonstationary Learning Characteristics of the LMS Adaptive Filter", Proceedings of the IEEE, vol. 64, No. 8, pp. 1151–1161, Aug. 1976.

CCITT Recommendation G.721, "32 kb/s Adaptive Differential Pulse Code Modulation (ADPCM)", CCITT Red Book, Fascicle III.3, pp. 55–93, Oct. 1984.

Gray, R. M., "Vector Quantization", IEEE ASSP Magazine, vol. 1, pp. 4–29, Apr. 1984.

Linde, Y., Buzo, A., and Gray, R. M., "An Algorithm for Vector Quantizer Design", IEEE Transactions in Communications, vol. COM-28, Jan. 1980, pp. 84–95.

Cuperman, V., and Gersho, A., "Vector Predictive Coding of Speech at 16 kbit/s", IEEE Trans. on Comm., vol. COM-33, pp. 685–696, Jul. 1985.

Atal, B. S., Schroeder, M. R., "Code-Excited Linear Prediction (CELP): High-Quality Speech at Very Low Bit Rates", Proc. 1985 ICASSP, pp. 25.1.1–25.1.4.

Chen, J.-H., and Gersho, A., "Vector Adaptive Predictive Coding of Speech at 9.6 kb/s", Proc. 1986 ICASSP, 33.4.1–4.

Chen, J.-H., and Gersho, A., "Gain-Adaptive Vector Quantization with Application to Speech Coding", IEEE Trans. on Comm., No. 9, pp. 918–930, Sep. 1987.

Rabiner, L. R., Cheng, M. J., Rosenberg, A. E., McGonegal, C. A., "A Comparative Performance Study of Several Pitch Detection Algorithms", IEEE Trans. on ASSP, vol, ASSP-24, pp. 339–417, Oct. 1976.

Jerry Gibson, "Adaptive Prediction in Speech Differential Encoding Systems", Proc. IEEE, vol. 68, No. 4, Apr., 1980, pp. 488–525.

Watts, Lloyd & Cuperman, Vladimir, "Design of a 16 kbit/s Vector ADPCM Speech Coding Algorithm", Proc. Canadian Conf. on Electrical & Computer Engineering, Nov. 1988, Vancouver, Canada.

Watts, Lloyd & Cuperman, Vladimir, "A Vector ADPCM Analysis-by-Synthesis Configuration for 16 kibt/s Speech Coding" Proc. IEEE Global Telecommunications Conf., Nov.-Dec. 1988, pp. 275–279.

*Primary Examiner*—Emanuel S. Kemeny

*Attorney, Agent, or Firm*—Barrigar & Oyen

[57] ABSTRACT

A method of encoding speech sounds to facilitate their transmission to and reconstruction at a remote receiver. A transmitter and a receiver have identical filters and identical codebooks containing prestored excitation vectors which model quantized speech sound vectors. The speech sound vectors are compared with filtered versions of the codebook vectors. The filtered vector closest to each speech sound vector is selected. During the comparison, filtration parameters derived by backward predictive analysis of a series of previously selected filtered codebook vectors are applied to the filter. The transmitter sends the receiver an index representative of the location of the selected vector within the codebook. The receiver uses the index to recover the selected vector from its codebook, and passes the recovered vector through its filter to yield an output signal which reproduces the original speech sound sample. By applying the same backward predictive analysis technique employed by the transmitter to the same series of previously selected filtered codebook vectors to which the transmitter applied the technique, the receiver derives the same combination of filtration parameters which the transmitter applied to its filter while selecting the codebook vector corresponding to the transmitted index.

9 Claims, 2 Drawing Sheets

LOW-DELAY VECTOR BACKWARD PREDICTIVE CODING OF SPEECH

FIELD OF THE INVENTION

This application pertains to a method of encoding speech sounds for transmission to a remote receiver. Only indices which point to stored vectors similar to discrete speech segments are sent to the receiver. The receiver recovers the corresponding vector and adapts itself to best replicate the speech segments by applying a backward predictive analysis technique to previously recovered speech segments.

BACKGROUND OF THE INVENTION

Digitized speech sounds consume relatively large amounts of signal bandwidth. Accordingly, telecommunications systems employ various data compression or "speech coding" schemes to convert speech sounds into codes which consume comparatively small amounts of signal bandwidth. Instead of transmitting the original speech sounds, or their digitized equivalents, the system transmits only the codes to a remote receiver which decodes them to reproduce the original speech sounds. The system thus conserves the available transmission bandwidth, making it possible to simultaneously transmit larger volumes of speech sounds, without resorting to an expensive increase in bandwidth. The prior art has evolved a variety of speech coding techniques, all having the objective of minimizing the information which must pass from the transmitter to the receiver, while enabling the receiver to faithfully reproduce the original speech sounds.

State of the art speech coding techniques typically employ a transmitter and a receiver having identical filters and identical "excitation codebooks". The excitation codebooks contain a variety of prestored waveform shapes or "codevectors", each codevector consisting of a plurality of samples. The codevectors are used to excite the filters, to which periodically updated filtration parameters are applied, thereby enabling the filters to model changes in a speaker's vocal tract. The filters output reconstructed speech vectors which are compared with the input speech sound vectors to select the reconstructed speech vectors which most closely approximate the original speech.

At the transmitter, series of previously reconstructed speech vectors are periodically compared to the input speech vectors, to select the codevector sequence which yields the best reconstructed speech vector. The transmitter sends to the receiver a sequence of codebook indices, which represent the locations of the selected codevectors within the codebook, together with the filtration parameters which were applied to the transmitter's filter while the codevectors were selected. The receiver uses the received sequence of codebook indices to recover the selected codevectors from its own codebook, decodes the transmitted filtration parameters and applies them to its own filter, then passes the recovered codevectors through the filter to yield a sequence of reconstructed speech vectors which reproduce the original speech sounds.

The present invention improves upon the prior art speech coding technique aforesaid by eliminating the need to transmit the filtration parameters to the receiver. Only the codebook indices are transmitted. The transmitter and the receiver apply a backward predictive analysis technique to previously recovered codevectors to derive the required filtration parameters.

SUMMARY OF THE INVENTION

The invention provides a method of encoding speech sounds to facilitate their transmission to and reconstruction at a remote receiver. The original speech sounds are sampled at discrete intervals to produce a sequence of speech sound samples. Consecutive sequences of these samples are grouped together to form a plurality of speech sound vectors x(n). The transmitter is provided with a codebook containing a plurality of prestored excitation codevectors v(n), selected groups of which are input to a first filter to which preselected filtration parameters are applied, causing the first filter to adaptively model the speaker's vocal tract. Each speech sound vector is sequentially compared with each one of the filtered codevectors, and the filtered codevector which most closely approximates that speech sound vector is selected. The transmitter sends the receiver an index $i_o$ representative of the location of the selected codevector within the codebook.

The filtration parameters applied to the first filter are selected by backward predictive analysis of a series of filtered codevectors previously selected as most closely approximating speech sound vectors previously processed by the transmitter, and in respect of which codebook indices have previously been transmitted to the receiver. The filtration parameters are applied to the first filter while the selected codevector is filtered through the first filter, causing the first filter to produce an output signal z(n) which closely approximates the input speech sound vector x(n).

The receiver has its own codebook of codevectors v(n), identical to the transmitter's codebook, and is thus able to use the received index $i_o$ to recover the codevector selected by the transmitter. By applying the same backward predictive analysis technique employed by the transmitter to the same series of previously selected codevectors to which the transmitter applied the technique, the receiver derives the same combination of filtration parameters which the transmitter applied to the first filter while selecting the codevector corresponding to the transmitted index. The receiver has a second filter, identical to the first filter. The receiver applies said particular combination of filtration parameters to the second filter and then filters the recovered codevector through the second filter to replicate the speech sound vector for which the transmitter selected the transmitted index.

Advantageously, the first and second filters each comprise a "norm predictor" which acts as a gain control, by amplifying the codevector v(n) to yield an output vector u(n); a "pitch predictor", which alters the periodicity of the amplified codevector to produce an output signal y(n) corresponding to the fundamental pitch of the speaker's voice; and, a "short-term predictor" which models the formant frequencies contained in the speaker's voice to yield the reconstructed speech vector z(n). The "filtration parameters" aforesaid consist of a number of parameters which are separately applied to each of three predictors aforesaid. The filtration parameters are adaptively updated, with the aid of backward predictive analysis techniques, to ensure that the reconstructed speech vector z(n) properly reflects changes in the speaker's vocal patterns. For example, the filtration parameters applied to the norm predictor are adapted by deriving the logarithms of the vector norms of each one of a sequence of previously reconstructed speech vectors, linearly combining the logarithms, and then computing the anti-logarithm of the combined result to produce the gain-scaled vector u(n).

Preferably, the pitch predictor has a plurality of variable filter coefficients, which are periodically initialized by applying a backward predictive analysis to a series of previously reconstructed speech vectors. The pitch predictor also preferably has a variable pitch period coefficient, which is be periodically initialized by applying a backward predictive analysis to the previously reconstructed speech vectors.

DETAILED DESCRIPTION OF THE PREFERRED EMBODIMENT

I. Basic Configuration

Figure 1:
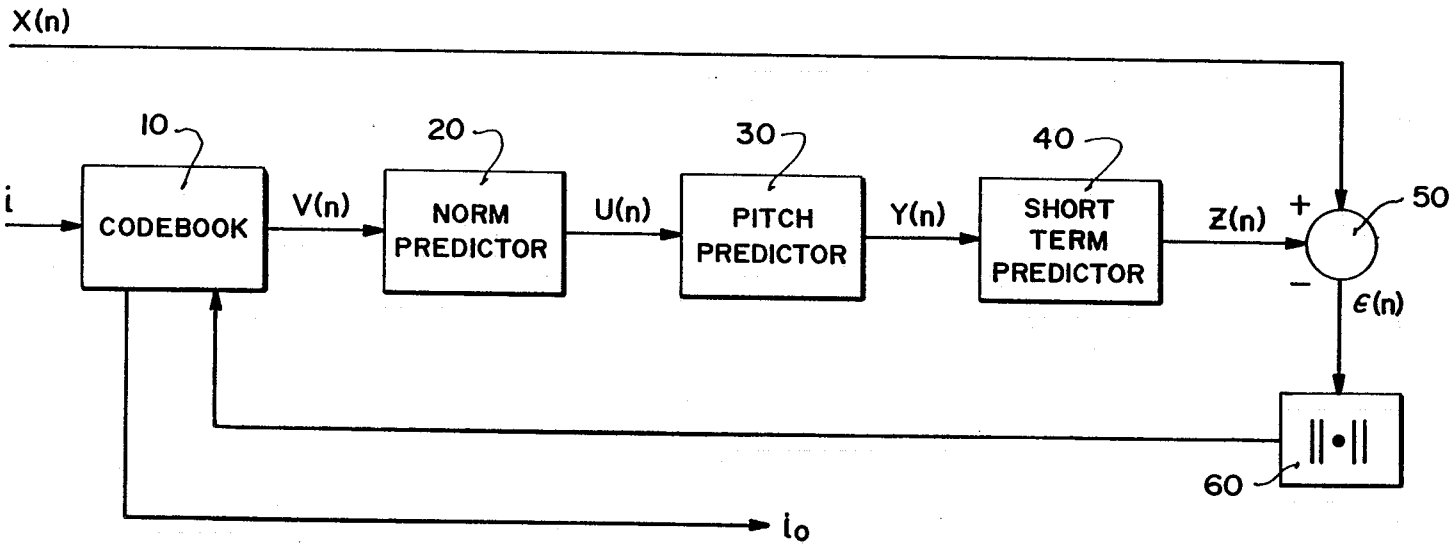
FIG. 1 is a simplified block diagram of a transmitter employing a pitch predictor filter in accordance with the preferred embodiment of the invention.
Figure 2:
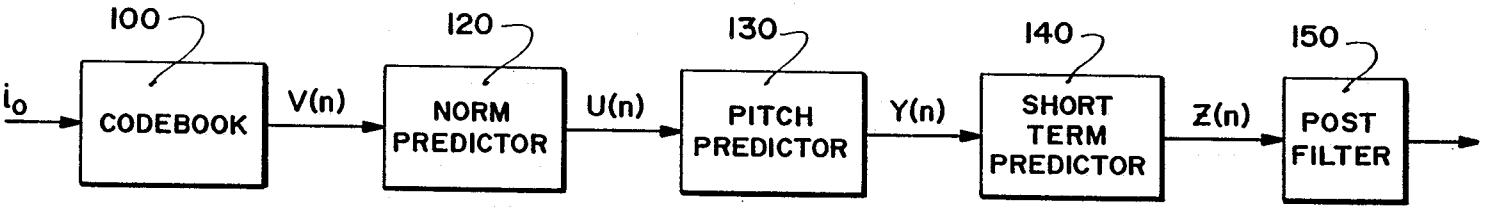
FIG. 2 is a simplified block diagram of a receiver employing a pitch predictor filter in accordance with the preferred embodiment of the invention.

FIG. 1 is a block diagram of a transmitter constructed in accordance with the preferred embodiment of the invention, and employing an analysis-by-synthesis ("A-S") speech coding configuration, including codebook 10 and a "first filter" consisting of three sub-filters; namely, backward-adaptive norm predictor 20, backward-adaptive pitch predictor 30, and backward-adaptive pole-zero short-term predictor 40. FIG. 2 is a block diagram of a receiver constructed in accordance with the preferred embodiment of the invention, and incorporating a codebook 100 identical to the transmitter's codebook 10; and, a "second filter" consisting of three sub-filters; namely, a backward-adaptive norm predictor 120 identical to the transmitter's norm predictor 20, a backward-adaptive pitch predictor 130 identical to the transmitter's pitch predictor 30, and a backward-adaptive pole-zero short-term predictor 140 identical to the transmitter's short-term predictor 40.

At discrete intervals, the transmitter samples the speech sounds which are to be transmitted, producing a plurality of speech sound samples. Consecutive sequences of these speech sound samples are grouped together to form a plurality of speech sound vectors x(n) which are fed to differential comparator 50. Codebooks 10, 100 each contain an identical plurality of prestored "excitation waveforms" or "codevectors" v(n) which model a wide variety of speech sounds. The transmitter sequentially filters selected groups of the codevectors in codebook 10 through norm predictor 20, pitch predictor 30, and short-term predictor 40, to produce a sequence of reconstructed speech vectors z(n) which are also fed to comparator 50. Differential comparator 50 sequentially compares the input speech sound vector x(n) with each of the reconstructed speech Vectors z(n) and outputs an error signal $\epsilon(n)$ for each reconstructed speech vector representative of the accuracy with which that reconstructed speech vector approximates the input speech sound vector x(n). The codevector corresponding to the reconstructed speech vector z(n) which most closely approximates the input speech sound vector x(n) (i.e. for which $\epsilon(n)$ is smallest) is selected.

The filtration parameters applied to predictors 20, 30 and 40 are adaptively updated, as hereinafter described, by backward predictive analysis of a series of previously reconstructed speech vectors. The transmitter sends to the receiver an "index" $i_0$ representative of the location of the selected codevector within each of codebooks 10, 100. The receiver uses the index to recover the selected codevector from codebook 100.

The codebook search proceeds as follows. For a trial index, i, a selected codevector $v(n)^{(i)}$ is processed through norm 15 predictor 20 to produce a corresponding amplified codevector $u(n)^{(i)}$:

$$u(n)^{(i)} = G^* V(n)^{(i)} \tag{1}$$

"G" is determined using the logarithm of previous vector norms, as described below under the heading "Norm Predictor Adaptation". The amplified codevectors $u(n)^{(i)}$, are then processed through pitch predictor 30 to produce a corresponding group of pitch-predicted samples $y(n)^{(i)}$:

$$y(n)^{(i)} = u(n)^{(i)} + \sum_{k=-1}^{1} a_k y(n - k_p - k) \tag{2}$$

where the pitch predictor coefficients $a_{-1}$, $a_0$, and $a_1$, and the pitch period $k_p$, are determined as described below under the heading "Pitch Predictor Adaptation".

The pitch-predicted samples $y(n)^{(i)}$ are then processed through short-term predictor 40 to produce the reconstructed speech vectors, $z(n)^{(i)}$:

$$z(n)^{(i)} = y(n)^{(i)} + \sum_{k=1}^{\rho} b_k z(n - k) + \sum_{k=1}^{z} c_k y(n - k) \tag{3}$$

where $\rho$ is the number of poles and z is the number of zeroes. The short-term predictor coefficients $b_k$ and $c_k$ are determined as described below under the heading "Short-Term Predictor Adaptation".

The squared reconstruction error for the codevector is:

$$D^{(i)} = \sum_{n=n_0}^{n_0+k-1} (x(n)^{(i)} - z(n)^{(i)})^2 \tag{4}$$

where k is the vector dimension and $n_0$ is the sample number of the first sample in the vector. This procedure is repeated for i=1,2, . . . ,N where N is the number of codevectors selected from codebook 10 for filtration through predictors 20, 30 and 40, and comparison with the input speech sound vector x(n). The index $i_0$ representative of the location, within codebook 10, of the L codevector which minimizes the squared reconstruction error $D^{(i)}$ is selected:

$$i_0 = ARGMIN_i[D^{(i)}] \tag{5}$$

Codebooks 10, 100 are initially developed using the prediction residuals $e(n)^{(i0)}$:

$$e(n)^{(i0)} = x(n) - \hat{X}(n)^{(io)} \tag{6}$$

where $x(n)^{(io)} = z(n)^{(i0)} - u(n)^{(i0)}$; which are grouped into vectors of the form $[e(n)^{(i0)}]$ for $n = n_0$ through $n = n_0 + k - 1$ and clustered using the LBG algorithm (see: Y. Linde, A. Buzo, and R. M. Gray, "An Algorithm for Vector Quantizer Design", IEEE Trans. Comm., Vol. COM-28, pp. 84–95, Jan. 1980).

II. Norm Predictor Adaptation

The gain G(n) used to multiply the codevector $v(n)^{(i)}$ to form the amplified codevector $u(n)^{(i)}$ is calculated using the recursive relationship:

$$\log G(n) = \log(\| V(n) \| / k) + \sum_{j=1}^{10} h_g(j) \log G(n-j) \tag{7}$$

where k is the vector dimension, and $\| v(n) \|$ is given by:

$$\| v(n) \| = \left( \sum_{n=n_0}^{n_0+k-1} (v(n))^2 \right)^{\frac{1}{2}} \tag{8}$$

In this notation, the index n labels successive vectors. The filter coefficients $h_g(j)$ are constant, and are as follows:

$h_g(1)=0.508$
$h_g(2)=0.075$
$h_g(3)=0.044$
$h_g(4)=0.050$
$h_g(5)=0.047$
$h_g(6)=0.051$
$h_g(7)=0.036$
$h_g(8)=0.029$
$h_g(9)=0.057$
$h_g(10)=0.068$

The foregoing filter coefficients are calculated by applying LPC analysis to a sequence of logarithms of vector norms for a typical sequence of speech samples.

III. Pitch Predictor Adaptation

The pitch predictor parameters which require adaptation are the pitch period $k_p$ and the pitch predictor coefficients $a_i$. Both the pitch period and the pitch predictor coefficients are initialized periodically. Between such periodic initializations, both are adapted on a sample-by-sample basis. The procedure used to initialize and adapt these parameters will now be described with reference to FIG. 3.

(a) Pitch Period Initialization

In order to perform pitch prediction, an accurate estimate of the pitch period of the signal is required. The autocorrelation method is used to calculate the pitch period.

Figure 3:
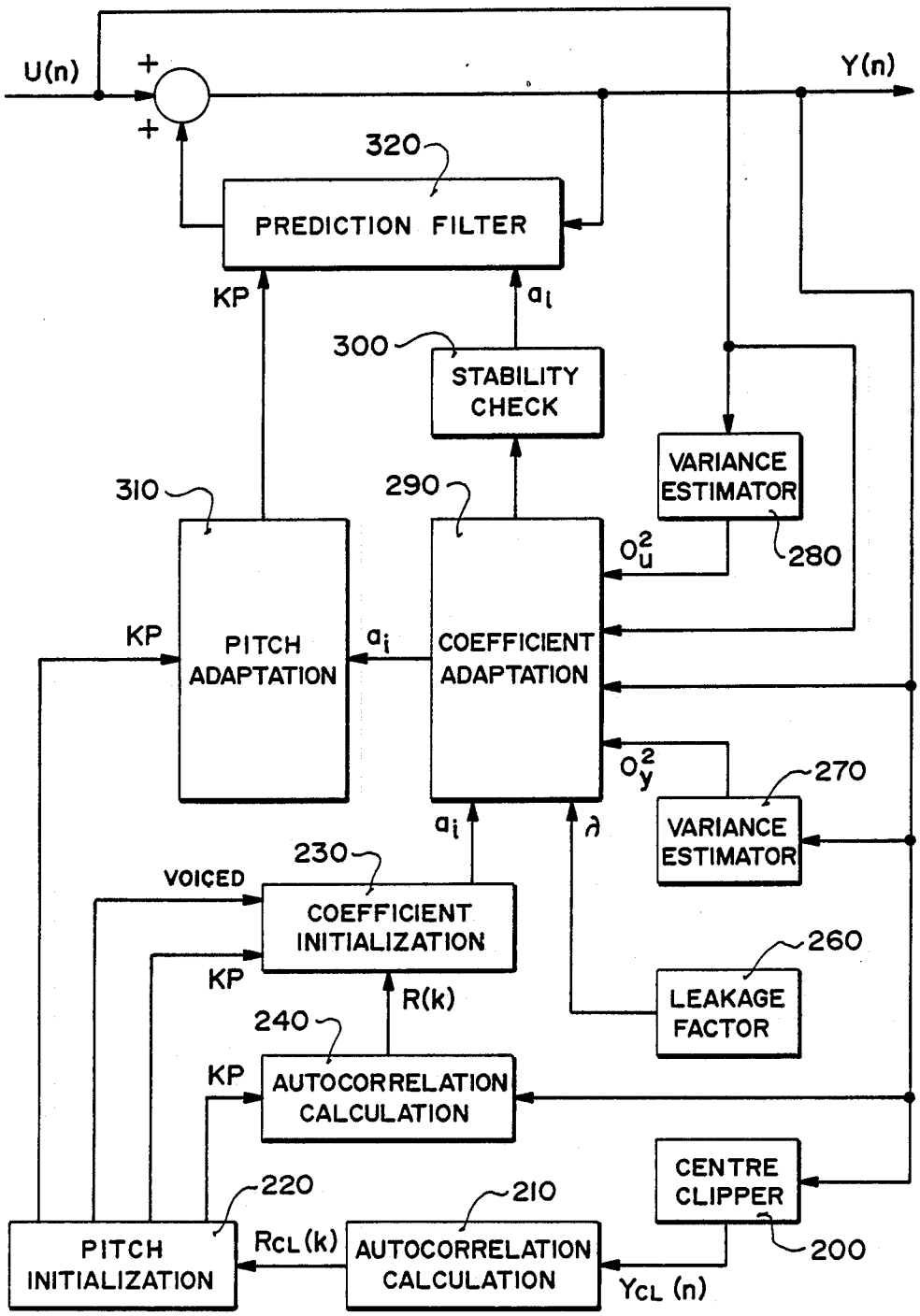
FIG. 3 is an expanded block diagram of the pitch predictor filter component of the transmitter and receiver of FIGS. 1 and 2.

To calculate the pitch period, a "frame" consisting of the preceding typically N=256 samples of pitch predictor output y(n) are accumulated and then centre clipped (block 200 in FIG. 3). The centre clipping is performed as follows:

1. The absolute peak of y(n) evaluated in the first third of the frame $y_{max1}$ and in the last third of the frame, $y_{max3}$ are determined.
2. The clip level $C_L$ is set to be 64% of the lesser of $Y_{max1}$ and $Y_{max3}$.
3. The centre-clipped signal $y_{cl}(n)$ is defined to be:

$$y_{cl}(n) = \begin{cases} +1 \text{ if } y(n) > +C_L \\ -1 \text{ if } y(n) < -C_L \\ 0 \text{ otherwise} \end{cases} \tag{9}$$

The autocorrelation function $R_{cl}(k)$ of the centre-clipped signal $y_{cl}(n)$ is then calculated (block 210 in FIG. 3) at lags from 20 to 125. The autocorrelation function is defined as:

$$R_{cl}(k) = \sum_{i=0}^{N-k-1} y_{cl}(i) y_{cl}(i+k) \tag{10}$$

The pitch period $k_p$ is determined (block 220 in FIG. 3) by finding the peak in $R_{cl}(k)$. A decision is then made on whether the speech segment contains voiced or unvoiced speech. If $R_{cl}k_p)/R_{cl}(O)<0.3$, then the speech is defined to be unvoiced. Otherwise, it is defined to be voiced. If the speech is unvoiced, then the pitch period is set to a predefined constant, $k_{p0}$.

(b) Filter Coefficient Initialization

The pitch predictor filter coefficients $a_i$ are initialized periodically (block 230 of FIG. 3). This initialization first requires the evaluation of the autocorrelation function $R_{yy}(k)$ of y(n), at k=0, 1, 2, $k_{p-1}$, $k_p$, $k_{p+1}$, which is done in block 240 of FIG. 3. The preceding 256 samples of y(n) are buffered and input into the circuitry represented by block 240. The pitch period $k_p$ is input into block 240 from block 220, to determine the points at which to evaluate the autocorrelation function. Equation 10 is used to calculate $R_{yy}(k)$, with y(n) substituted for $y_{cl}(n)$.

The pitch predictor filter coefficients $a_i$ are calculated in block 230 of FIG. 3. The pitch period $k_p$ and a voiced/unvoiced flag (also output from block 220 in FIG. 3) are input into block 230 from block 220. If the speech is unvoiced, no further calculation is required, and the coefficients $a_i$ are set to zero. If the speech is voiced, the coefficients are calculated by solving the Wiener-Hopf equations:

$$\begin{pmatrix} R_{yy}(0)+\mu & R_{yy}(1) & R_{yy}(2) \\ R_{yy}(1) & R_{yy}(0)+\mu & R_{yy}(1) \\ R_{yy}(2) & R_{yy}(1) & R_{yy}(0)+\mu \end{pmatrix} \begin{pmatrix} a_{-1} \\ a_0 \\ a_{+1} \end{pmatrix} = \begin{pmatrix} R_{yy}(k_p-1) \\ R_{yy}(k_p) \\ R_{yy}(k_p+1) \end{pmatrix} \tag{11}$$

where $\mu$ is a constant softening factor, $\mu=0.03$.

(c) Filter Coefficient Adaptation

The pitch predictor filter coefficients are adapted on a sample by sample basis. This adaptation is performed until a new coefficient initialization is accepted from block 230 in FIG. 3.

Block 260 in FIG. 3 supplies the leakage factor $\lambda$ for the adaptation. This leakage factor is necessary to recover from channel bit errors. $\lambda$ is nominally a constant, $\lambda=225/256$. However, if the channel bit error rate is high, (greater than 1 error per 1000 bits), then a leakage factor of $\lambda=63/64$ will result in better system performance. If a channel quality estimator is available, $\lambda$ should be adapted according to its value.

Block 270 in FIG. 3 calculates a running estimate of the variance of y(n), $\sigma_y^2(n)$ using the following equation:

$$\sigma_y^2(n)=0.9\sigma_y^2(n-1)+0.1(y(n)))^2 \quad (12)$$

Block 280 in FIG. 3 calculates a running estimate of the variance of u(n), $\sigma_u^2(n)$, by using equation (12) with u(n) substituted for y(n) and $\sigma_u^2(n)$ substituted for $\sigma_y^2(n)$.

Block 290 of FIG. 3 adapts the filter coefficients between the periodic initializations, on a sample-by-sample basis, using the backward adaptive LMS algorithm. The algorithm is defined as follows:

$$\begin{pmatrix} a_{-1}(n) \\ a_0(n) \\ a_{+1}(n) \end{pmatrix} = \lambda \begin{pmatrix} a_{-1}(n-1) \\ a_0(n-1) \\ a_{+1}(n-1) \end{pmatrix} + \alpha/(\sigma_u\sigma_y) \begin{pmatrix} u(n)y(n-k_p+1) \\ u(n)y(n-k_p) \\ u(n)y(n-k_p-1) \end{pmatrix} \quad (13)$$

where $\alpha$ is the constant gradient step size, $\alpha=1/128$.

A stability check is performed on the new coefficients in block 300 of FIG. 3. If the stability constraints indicate an unstable filter, then the coefficients are not adapted. The following stability constraints (described by R. P. Ramachandran and P. Kabal in "Stability and Performance Analysis of Pitch Filters in Speech Coders", I.E.E.E. Trans. ASAP, Vol. ASSP-35, pp. 937–946, Jul., 1987) are employed:

$$\text{Let: } f = |a_{-1}r^2 + a_{+1}|$$

$$g = |a_{-1}r^2 - a_{+1}|$$

If $|f| \geqq |g|$, then $|a_{-1}|r^2 + |a_0|r + |a_{+1}| < r^{kp+1}$.

If $|f| < |g|$, then $a_0 r + f < r^{kp+1}$; and, $$g^2 \leqq |f| r^{kp+1}, \text{ or } g^2a_0^2r^2 - (r^{2(kp+1)} - g^2)(g^2 - f^2) < 0$$

where r=0.94.

(d) Pitch Period Adaptation

Block 310 of FIG. 3 adapts the pitch period $k_p$ between the periodic updates, on a sample-by-sample basis, using a backward adaptive algorithm. The pitch period is adapted using an empirical algorithm based on examining the current set of filter coefficients. A decision is made to increment the pitch period by one if the following conditions are true:

1. the pitch predictor coefficient $a_{+1}$ is greater than 0.1; and,
2. the time derivative $\dot{a}_{+1}$ is greater than 1/800; and,
3. the time derivative $\dot{a}_{+1}$ is greater than the time derivative $\dot{a}_0$.

Similarly, a decision is made to decrement the pitch period $k_p$ by one if the above conditions are true for $a_{-1}$.

The time derivative of each of the pitch predictor coefficients is calculated by the following equation:

$$\dot{a}_j^{(n)}=(a_j^{(n)}-a_j^{(n-8)})/8 \quad (14)$$

where n is the time index.

If the pitch period is modified, then the filter coefficients are shifted by one, and the new filter coefficient is calculated to be $\frac{2}{3}$ of $a_0$. If the resulting set of filter coefficients would result in an unstable system, as determined by the stability constraints aforesaid, then the new filter coefficient is set to zero.

(e) Pitch Prediction Filter

Block 320 in FIG. 3 contains the pitch prediction filter. The filter equation is given above as Equation (2).

IV. Short-term Predictor Adaptation

The short-term predictor coefficients are determined by a backward-analysis approach known as the LMS algorithm (see: N. S. Jayant, P. Noll, "Digital Coding of Waveforms", Prentice Hall, 1984; or, CCITT Recommendation G-721). Each predictor coefficient is updated by adding a small incremental term, based on a polarity correlation between the reconstructed codevectors which are available at both the transmitter and receiver. The equations are as follows:

$$c_j^{(n+1)} = 255/256\, c_j^{(n)} + 1/128 \text{ sgn } y(n) \text{ sgn } y(n-j);\ j = 1,6$$

$$b_1^{(n+1)} = 255/256\, b_1^{(n)} + 3/256 \text{ sgn } Z'(n) \text{ sgn } Z'(n-1)$$

$$b_2^{(n+1)} = 127/128\, b_2^{(n)} + 1/128 \text{ sgn } Z'(n) \text{ sgn } Z'(n-2) - 1/128\, f[b_1(n)] \text{ sgn } Z'(n) \text{ sgn } Z'(n-1)$$

where:

$$f[b_1(n)] = 4b_1(n) \text{ if } |b_1(n)| \leqq \tfrac{1}{2}; \text{ or, } 2\text{sgn}(b_1(n)) \text{ if } |b_1(n)| > \tfrac{1}{2}; \text{ and}$$

$$Z'(n) = y(n) + \sum_{i=1}^{6} c_i(n)y(n-i)$$

V. Complexity Reduction

The basic algorithm described above requires a large number of computations, due to the fact that each codevector must be filtered through norm predictor 20, pitch predictor 30, and short term predictor 40, before the transmitter may select the reconstructed codevector which most closely approximates the input speech sound vector.

Three methods are used to reduce the number of computations. The first step in complexity reduction is based on the fact that the predictor coefficients $b^{(i)}$ and $c^{(i)}$ change slowly, and thus these coefficients need not be updated while the optimal codevector is selected.

The second complexity reduction method exploits the fact that the output of the predictor filter consists of two components. The zero-input-response $x(n)_{ZIR}$ is the filter output due only to the previous vectors The zero-state-response $x^{(i)}(n)_{ZSR}$ is the filter output due only to the trial codevector i, such that:

$$\hat{x}(n)^{(i)}=\hat{x}(n)_{ZIR}+\hat{x}^{(i)}(n)_{ZSR} \quad (15)$$

For each search through codebook 10, the zero-input-response may be precomputed and subtracted from the input samples, to produce the partial input sample:

$$x(n)^*=x(n)-\hat{x}(n)_{ZIR} \quad (16)$$

The partially reconstructed speech sample:

$$z^{(i)}(n)_{ZSR}=u(n)^{(i)}+\hat{x}^{(i)}(n)_{ZSR} \quad (17)$$

is then subtracted from the partial input sample x(n)* to produce the reconstruction error:

$$x(n)-z^{(i)}(n)=x(n)^*-z^{(i)}(n)_{ZSR} \quad (18)$$

The third complexity reduction method is -based on the following observation: the filter coefficients change slowly, and thus the partially reconstructed samples $z^{(i)}(n)_{ZSR}$ for a given codevector also change slowly. Therefore, the $z^{(i)}(n)_{ZSR}$ filter outputs may be periodically computed and stored in a new zero-state-response state-response codebook. The use of such a technique requires holding the short term predictor coefficients constant between updates of the zero-state-response codebook. The apparent contradiction between the need to adapt the short term predictor coefficients on a sample-by-sample basis, and the need to hold these coefficients constant between updates of the zero-state-response codebook is resolved by keeping two sets of coefficients in memory. The first set of coefficients is used in the speech encoding process. The second set of coefficients is adapted on a sample-by-sample basis. Before the zero-state-response codebook is updated, the first set of coefficients is set equal to the second set of coefficients. This technique results in a substantial reduction in computational load, with only a slight performance degradation.

VI. Post-filtering

Postfiltering is an effective method of improving the subjective quality of the coded speech (see the paper by Jayant mentioned above). Postfilter 150 (FIG. 2) is derived by scaling the coefficients of short-term predictor 140 (see again the paper by Jayant mentioned above, and also see: N. S. Jayant and V. Ramamoorthy, "Adaptive Postfiltering of ADPCM Speech," Proc. ICASSP, pp. 16.4.1–16.4.4, Tokyo, Apr. 1986).

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A method of encoding speech sounds to facilitate transmission of said speech sounds from a transmitter to a remote receiver, and reconstruction of said speech sounds at said receiver, said method comprising the steps of:

(I) at said transmitter:

(a) sampling said speech sounds at discrete intervals to produce a plurality of speech sound samples;

(b) grouping together consecutive sequences of said speech sound samples to produce a plurality of speech sound vectors;

(c) for each one of said speech sound vectors:

(i) sequentially filtering a selected group of a first plurality of prestored excitation vectors through a first filter having preselected filtration parameters;

(ii) comparing said speech sound vector with each one of said selected group of filtered excitation vectors;

(iii) selecting one of said filtered excitation vectors which most closely approximates said speech sound vector;

(iv) transmitting to said receiver an index representative of the location, within said first plurality of prestored excitation vectors, of said selected excitation vector; and, (v) filtering said selected excitation vector through said first filter;

(d) periodically deriving, by backward predictive analysis of a filtered series of said excitation vectors previously selected during step (I)(c)(iii), a particular combination of said filtration parameters which, when applied to said first filter, while a particular one of said selected excitation vectors is filtered through said first filter, causes said first filter to produce an output signal z(n) which most closely approximates the particular one of said speech sound vectors for which said particular excitation vector was selected; and, (e) applying said derived filtration parameters to said first filter as said preselected filtration parameters;

(II) at said receiver:

(a) recovering said selected excitation vector from a location, defined by said index, within a second plurality of prestored excitation vectors identical to said first plurality of excitation vectors;

(b) with the same periodicity at which step (I)(d) is performed, concurrently periodically deriving said particular combination of said filtration parameters by said backward predictive analysis of a filtered series of said excitation vectors previously recovered by said receiver, and identical to said series of said excitation vectors selected during step (I)(c)(iii);

(c) applying said particular combination of said filtration parameters to a second filter identical to said first filter; and, (d) filtering said recovered excitation vector through said second filter.

2. A method as defined in claim 1, wherein:

(a) said prestored excitation vectors are gain normalized vectors v(n); and, (b) said backward predictive analysis comprises deriving the logarithm of the vector norm of each of said prestored excitation vectors, linearly combining said logarithms, and then deriving the antilogarithm of said linear combination to produce a gain-scaled vector u(n).

3. A method as defined in claim wherein said backward predictive analysis further comprises deriving the fundamental frequency of said speech sound vector to produce a pitch predicted vector y(n).

4. A method as defined in claim 3, wherein said first and second filters each further comprise a pitch predictor filter having a plurality of variable filter coefficients, said method further comprising periodically initializing said coefficients by applying a backward predictive analysis to said filtered series of previously selected excitation vectors.

5. A method as defined in claim 4, wherein said pitch predictor filters each further comprise a variable pitch period coefficient, said method further comprising periodically initializing said pitch period coefficient by applying said backward predictive analysis to said filtered series of previously selected excitation vectors.

6. A method as defined in claim 5, further comprising first, second and third filter coefficients $a_{-1}$, $a_0$, and $a_{+1}$, said method further comprising adapting said pitch period coefficient to changes in said filter coefficients, by:

(a) incrementing said pitch period coefficient by one if:

(i) filter coefficient $a_{+1} > 0.1$;and, (ii) the time derivative of $a_{+1} > 1/800$; and, (iii) the time derivative of $a_{+1} >$ the time derivative of $a_0$;

(b) decrementing said pitch period coefficient by one if:

(i) filter coefficient $a_{-1} > 0.1$; and, (ii) the time derivative of $a_{-1} > 1/800$; and, (iii) the time derivative of $a_{-1} >$ the time derivative of $a_0$; and, (c) holding said pitch period coefficient constant otherwise.

7. A method as defined in claim 2, wherein said variation of said filter parameters further comprises deriving, for each of said gain-scaled vectors u(n), a pitch predicted vector y(n) where:

$$y(n) = u(n) + \sum_{k=-1}^{+1} a(k)y(n - k_p - k)$$

where a(k) are filter coefficients, and $k_p$ is the current pitch period.

8. A method as defined in claim 7, further comprising deriving the pitch period of said pitch predicted vector y(n), by performing the steps of:

(a) accumulating 256 samples of said pitch predicted vector y(n);

(b) deriving the absolute peak $y_{max1}$ of y(n) for the first one-third of said 256 samples, and the absolute peak of $y_{max3}$ y(n) for the last one-third of said 256 samples;

(c) defining a clipping level $C_L = 64\%$ of the lesser of $y_{max1}$ and $y_{max3}$;

(d) deriving the centre-clipped signal $y_{cl}(n)$:

$$y_{cl}(n) = \begin{cases} +1 \text{ if } y(n) > +C_L \\ -1 \text{ if } y(n) < -C_L \\ 0 \text{ otherwise;} \end{cases}$$

(e) deriving the pitch period, $k_p$, as that value of k at which $R_{cl}(k)$ is a maximum, where:

$$R_{cl}(k) = \sum_{i=0}^{N-k-1} y_{cl}(i)y_{cl}(i + k); \text{ and,}$$

(f) if $R_{cl}(k_p)/R_{cl}(O) < 0.3$ then predefining $k_p$ as a predefined constant $k_{p0}$.

9. A method as defined in claim 8, further comprising determining said filter coefficients $a_i(k)$ by:

(a) if $R_{cl}(k_p)/R_{cl}(0) < 0.3$, then setting said filter coefficients $= 0$; or, (b) if $R_{cl}(k_p)/R_{cl}(0) \geqq 0.3$, then determining said filter coefficients in accordance with the formulae:

$$\begin{pmatrix} R_{yy}(0) + \mu & R_{yy}(1) & R_{yy}(2) \\ R_{yy}(1) & R_{yy}(0) + \mu & R_{yy}(1) \\ R_{yy}(2) & R_{yy}(1) & R_{yy}(0) + \mu \end{pmatrix} \begin{pmatrix} a_{-1} \\ a_0 \\ a_{+1} \end{pmatrix} = \begin{pmatrix} R_{yy}(k_p - 1) \\ R_{yy}(k_p) \\ R_{yy}(k_p + 1) \end{pmatrix};$$

where $\mu = 0.03$.

* * * * *